US005080073A

United States Patent [19]

Fujihara et al.

[11] Patent Number: 5,080,073

[45] Date of Patent: Jan. 14, 1992

[54] FUEL CONTROL APPARATUS FOR AN INTERNAL COMBUSTION ENGINE

[75] Inventors: Kunio Fujihara, Tokyo; Yoshiaki Kanno, Himeji, both of Japan

[73] Assignees: Mitsubishi Denki Kabushiki Kaisha; Mitsubishi Jidosha Kogyo Kabushiki Kaisha, both of Tokyo, Japan

[21] Appl. No.: 641,828

[22] Filed: Jan. 16, 1991

[30] Foreign Application Priority Data

Jan. 17, 1990 [JP] Japan ..... 2-9399

[51] Int. Cl.[5] ..... F02D 41/18

[52] U.S. Cl. ..... 123/488; 123/494

[58] Field of Search ..... 123/488, 494; 73/118.2

[56] References Cited

U.S. PATENT DOCUMENTS

| | | | |
|---|---|---|---|
| 4,721,087 | 1/1988 | Kanno et al. | 123/488 |
| 4,760,829 | 8/1988 | Kanno et al. | 123/488 |
| 4,805,577 | 2/1989 | Kanno et al. | 123/488 |
| 4,905,155 | 2/1990 | Kanno | 123/494 |
| 4,911,128 | 3/1990 | Hara et al. | 123/488 |
| 4,932,382 | 6/1990 | Fujimoto et al. | 123/494 |

*Primary Examiner*—E. Rollins Cross
*Assistant Examiner*—Robert E. Mates
*Attorney, Agent, or Firm*—Sughrue, Mion, Zinn, Macpeak & Seas

[57] ABSTRACT

A fuel control apparatus for an internal combustion engine comprises, an air intake quantity detector to detect a parameter related to an air intake quantity for the engine, a filter for filtering an output from the air intake quantity detector, a switch for changing the filter coefficient of the filter on the basis of operational conditions of the engine, a controller to control a fuel supply quantity to the engine on the basis of the output of the filter, and a corrector to correct the fuel supply quantity depending on an error between an output from the filter and another output from the same at a predetermined crank angle when the error exceeds a predetermined value, wherein the predetermined value is changed depending on the filter coefficient which is changed by the switch.

2 Claims, 8 Drawing Sheets

FIGURE 3
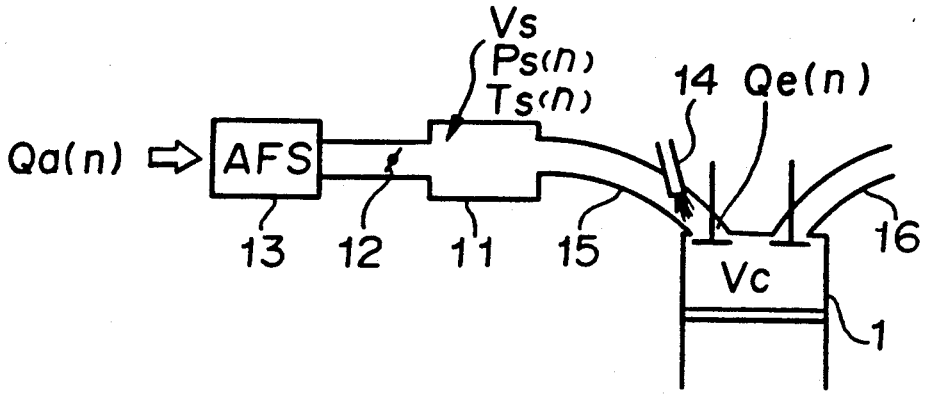
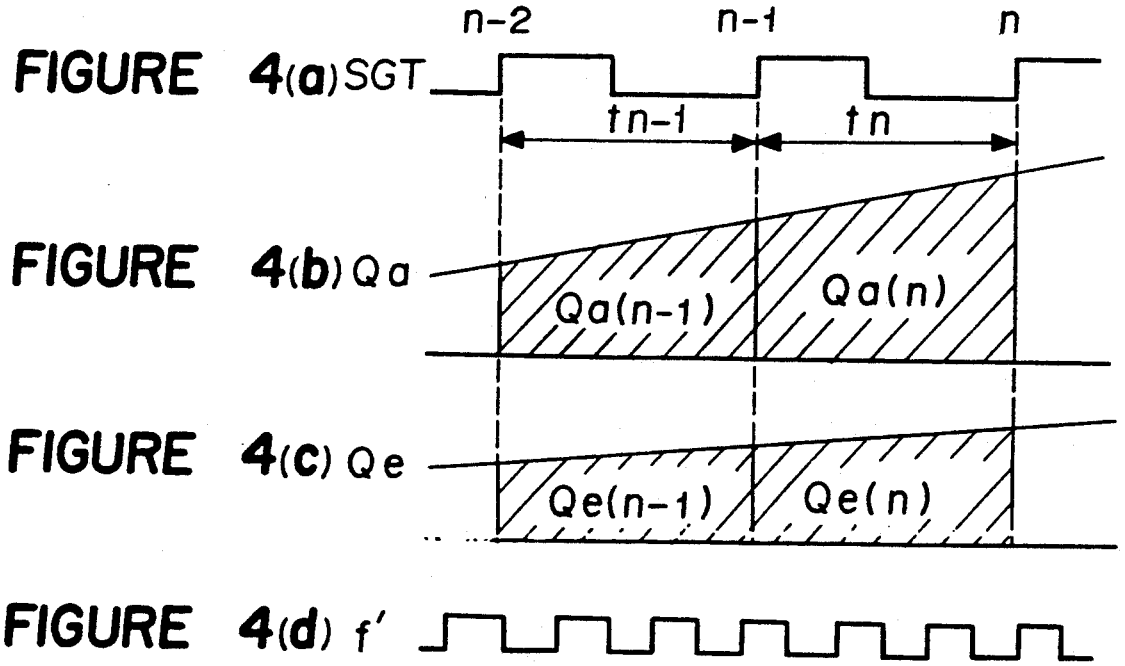

FIGURE 5(a)
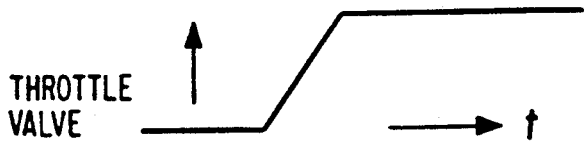
FIGURE 5(b) Qa
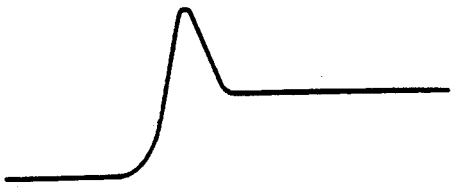
FIGURE 5(c) Qe
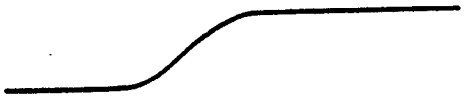
FIGURE 5(d) P
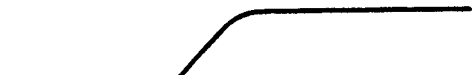
FIGURE 5(e) $\Delta$Qe
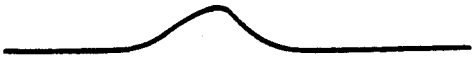
FIGURE 5(f) $f_I$
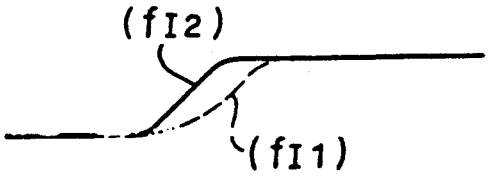

FIGURE 8
FIGURE 7
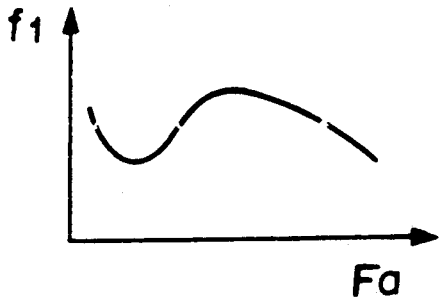
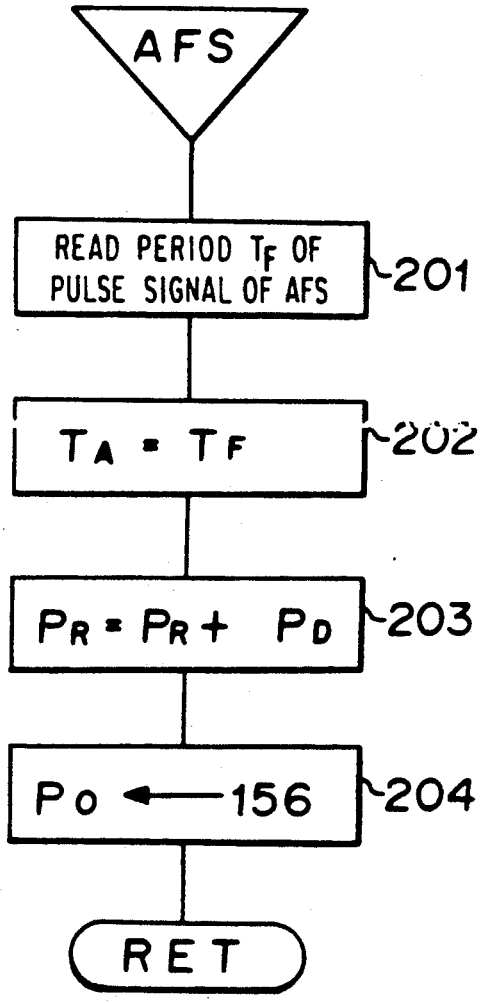

FIGURE 10(c) $P_D$

FIGURE 10(d) $P_R$

FUEL CONTROL APPARATUS FOR AN INTERNAL COMBUSTION ENGINE

BACKGROUND OF THE INVENTION

1. Field of the Invention

The present invention relates to a fuel control apparatus for an internal combustion engine wherein a parameter related to an air intake quantity to be sucked into the internal combustion engine is detected by an air intake quantity detecting means and fuel supply to the engine is controlled based on the output of the air intake quantity detecting means.

3. Discussion of Backgrounds

In controlling fuel for internal combustion engine, an air flow sensor (hereinafter, referred to as AFS) is disposed at the upstream of a throttle valve so as to detect an air intake quantity to the engine, and an air intake quantity per one suction is obtained by the information of the AFS and the number of revolution of the engine, whereby the fuel quantity to the engine is the controlled.

In the above-mentioned system wherein the AFS is disposed in an air intake passage at the upstream side of the throttle valve to thereby detect an air intake quantity to the engine, however, when the throttle valve is rapidly opened, the AFS detects an amount of air filled in the intake passage between the throttle valve and the internal combustion engine, whereby the AFS detects an amount of air more than the air quantity sucked into the internal combustion engine. In the conventional fuel control apparatus, the following measures were taken in order to eliminate the above-mentioned disadvantage. Namely, an air intake quantity per one suction was subjected to a filter treatment to thereby obtain a correct value of air intake quantity to be sucked into the internal combustion engine. Further, a delay in the filtering treatment and a delay in an air intake quantity detection output were corrected. In addition, correction of an incremental value was conducted in order to compensate a shortage of the fuel supply quantity at the time of acceleration of the engine when a change of the output by the filter treatment is a predetermined value or higher. Thus, the fuel control at a transition period was appropriately conducted.

The filter treatment is conducted on the basis of the formula described below, for instance.

$$AN_{(n)}=K_1\times AN_{(n-1)}+K_2\times AN_{(t)}$$

where $AN_{(t)}$ an air intake quantity obtained on the basis of an output from the AFS between predetermined crank angles in the internal combustion engine, $AN_{(n-1)}$: a sucked air intake quantity which has undergone a filter treatment at the last time, $AN_{(n)}$: a sucked air intake quantity which has undergone the filter treatment at the present time, and $K_1$, $K_2$: constants (where $K_1+K_2=1$)

In the above-mentioned formula, it is necessary to change the value of constants ($K_1$, $K_2$) for the filter treatment depending on operational conditions of the internal combustion engine. For instance, when the engine is in an idling operation, a change of revolution speed in an idling time can be reduced by reducing the constant $K_1$ to be smaller than an appropriate value. At this moment, however, a degree of variability in the value of air intake quantity which has been subjected to a filter treatment becomes large, whereby correction of the incremental value has to be carried out even in a time other than the transition period.

SUMMARY OF THE INVENTION

It is an object of the present invention to provide a fuel control apparatus for an internal combustion engine enabling a proper correction of incremental value even when a constant for the filter treatment is changed.

The foregoing and other objects of the present invention have been attained by providing a fuel control apparatus for an internal combustion engine comprising an air intake quantity detecting means to detect a parameter related to an air intake quantity for the internal combustion engine, a filter means for filtering an output from the air intake quantity detecting means, a switching means for changing the filter coefficient of the filter means on the basis of operational conditions of the internal combustion engine, a control means to control a fuel supply quantity to the internal combustion engine on the basis of the output of the filter means, and a correcting means to correct the fuel supply quantity depending on an error between an output from the filter means and another output from the same at a predetermined crank angle when the error exceeds a predetermined value, wherein the predetermined value is changed depending on the filter coefficient which is changed by the switching means.

BRIEF DESCRIPTION OF DRAWINGS

FIG. 3 is a structural view showing a typical air intake system for an internal combustion engine;

FIGS. 4(*a–d*) is a diagram showing a relation of an air intake quantity to a crank angle in the above-mentioned embodiment;

FIGS. 5*a–*5*f* are respectively waveform diagrams showing variation of the air intake quantity in the transition period in the internal combustion engine;

FIGS. 6, 8 and 9 are respectively flow charts showing an embodiment of the operations of the fuel control apparatus of the present invention;

FIG. 7 is a graph showing the relation between the basic driving time conversion factor and the AFS output frequency in the fuel control apparatus of the present invention.

DETAILED DESCRIPTION OF PREFERRED EMBODIMENT

Figure 1:
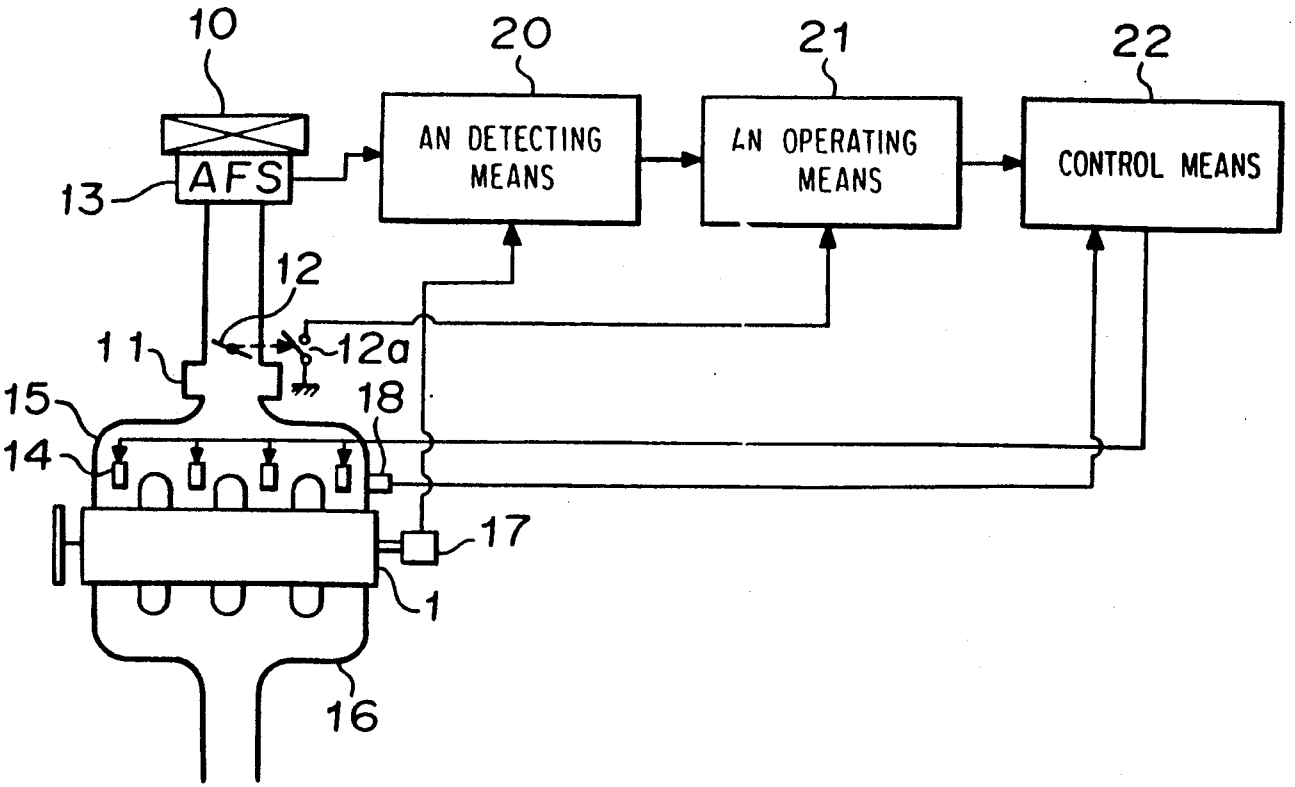
FIG. 1 is a block diagram of an embodiment of the fuel control apparatus according to the present invention.

An embodiment of the fuel control apparatus according to the present invention will be described with reference to the drawings.

FIG. 3 shows a model of an air intake system for an internal combustion engine 1. The internal combustion engine 1 has a volume of Vc per one stroke. The air is sucked in the internal combustion engine 1 through an air flow sensor (AFS) 13 of a Karman vortex flowmeter, a throttle valve 12, a surge tank 11 and an air intake pipe 15, and fuel is supplied to the engine by means of an injector 14. The volume of the air intake system from the throttle valve 12 to the internal combustion engine 1 is represented by Vs. A numeral 16 designates an exhaust pipe.

FIG. 4 shows the relation between the air intake quantity and a predetermined crank angle in the internal combustion engine, wherein FIG. 4a shows a crank angle signal (hereinbelow referred to as SGT) which is produced at every predetermined crank angle at the internal combustion engine 1, FIG. 4b shows an air intake quantity Qa passing through the AFS 13, FIG. 4c shows an air intake quantity Qe sucked into the internal combustion engine 1 and FIG. 4d shows an output pulse f' of the AFS 13. The period from the (n−2)th leading edge of the SGT to the (n−1)th leading edge of the SGT is represented by $T_{n-1}$, and the period from the (n−1)th leading edge to the nth leading edge of the SGT is represented by $t_n$. A sucked air quantity passing through the AFS 13 in the period $t_{n-1}$ and a sucked air quantity passing through the AFS 13 in the period $t_n$ are respectively represented by Qa(n−1) and Qa(n). An air quantity sucked into the internal combustion engine 1 in the period $t_{n-1}$ and an air quantity sucked in the engine in the period $t_n$ are respectively represented by Qe(n−1) and Qe(n). An average pressure and an average intake-air temperature in the surge tank 11 in the period $t_{n-1}$ and the period $t_n$ are respectively represented by Ps(n−1) and Ps(n) and Ts(n−1) and Ts(n). In this embodiment, Qa(n−1) corresponds to the number of output pulses of the AFS 13 in the period Tn−1. Further, since a rate of change of the intake-air temperature is small, Ts(n−1)≈Ts(n), and the charging efficiency of the internal combustion engine 1 is determined to be constant. Then, the following formulas are given.

$$Ps(n-1)\cdot Vc = Qe(n-1)\cdot R\cdot Ts(n) \quad (1)$$

$$Ps(n)\cdot Vc = Qe(n\cdot R\cdot Ts(n) \quad (2)$$

where R is a constant.

When an air intake quantity filled in the surge tank 11 and the air intake pipe 15 in the period $t_n$ is represented by ΔQa(n), the following formula is obtained.

$$\Delta Qa(n) = Qa(n) - Qe(n) = Vs\cdot\frac{1}{R\cdot Ts}\times(Ps(n) - Ps(n-1)) \quad (3)$$

From the formulas (1)–(3), the following formula is obtained.

$$Qe_{(n)} = \frac{1}{1+\frac{Vc}{Vs}}\cdot Qe_{(n-1)} + \left(1-\frac{1}{1+\frac{Vc}{Vs}}\right)\cdot Qa_{(n)} \quad (4)$$

Accordingly, the air quantity Qe(n) sucked into the internal combustion engine 1 in the period $t_n$ can be calculated by using the formula (4) on the basis of the air quantity Qa(n) passing through the AFS 13. Here, Vc=0.5 l and Vs=2.5 l and then, the following formula is obtainable.

$$Qe_{(n)} = 0.83\times Qe_{(n-1)} + 0.17\times Qa_{(n)} \quad (5)$$

FIG. 5 shows a condition of the throttle valve 12 being open. FIG. 5a shows a degree of opening of the throttle valve 12, FIG. 5b shows an air quantity which overshoots when the throttle valve 12 is opened, FIG. 5c shows an air quantity Qe sucked into the internal combustion engine 1 and corrected by the formula (4), FIG. 5d shows a pressure P in the surge tank 11, FIG. 5e shows a change of quantity ΔQe which is variation of Qe and FIG. 5f shows a fuel supply quantity $f_I$. In FIG. 5f, $f_{I1}$ is corrected on the basis of Qe and $f_{I2}$ is corrected on the basis ΔQe.

FIG. 1 is a block diagram of an embodiment of the fuel control apparatus for an internal combustion engine according to the present invention. In FIG. 1, a reference numeral 10 designates an air cleaner disposed at the upstream side of the AFS 13. The AFS 13 outputs pulses as shown in FIG. 4d corresponding to an air quantity sucked into the internal combustion engine 1. A crank angle sensor 17 outputs pulses (for instance, at a crank angle of 180° from the leading edge of a pulse to the next leading edge of it) as shown in FIG. 4a corresponding to the revolution of the internal combustion engine.

A numeral 20 designates an AN detecting means which counts the number of pulses outputted from the AFS 13 which fall between predetermined crank angles of the internal combustion engine 1.

A numeral 21 designates an AN operating means which performs the calculation in the same manner as the formula (5) when receives an output from the AN detecting means 20, and calculates the number of pulses corresponding to the output of the AFS 13 which corresponds to an air quantity which is considered to be sucked into the internal combustion engine 1.

A numeral 12a designates an idle switch which is capable of detecting the fully closing position of the throttle valve 12. When the idle switch 12a is in an ON state (when the throttle valve 12 is fully closed), the factor of a filter is made small. For instance, the value of 0.83 in the formula (5) is revised to be about 0.7–0.8.

A control means 22 receives an output of the AN operating means 21 and an output of a water temperature sensor (e.g. a thermistor) which detects the temperature of cooling water in the internal combustion engine, so that a driving time for driving an injector 14 is controlled so as to correspond to an air quantity to be sucked into the internal combustion engine, whereby the fuel quantity to be supplied to the internal combustion engine 1 is controlled.

Figure 2:
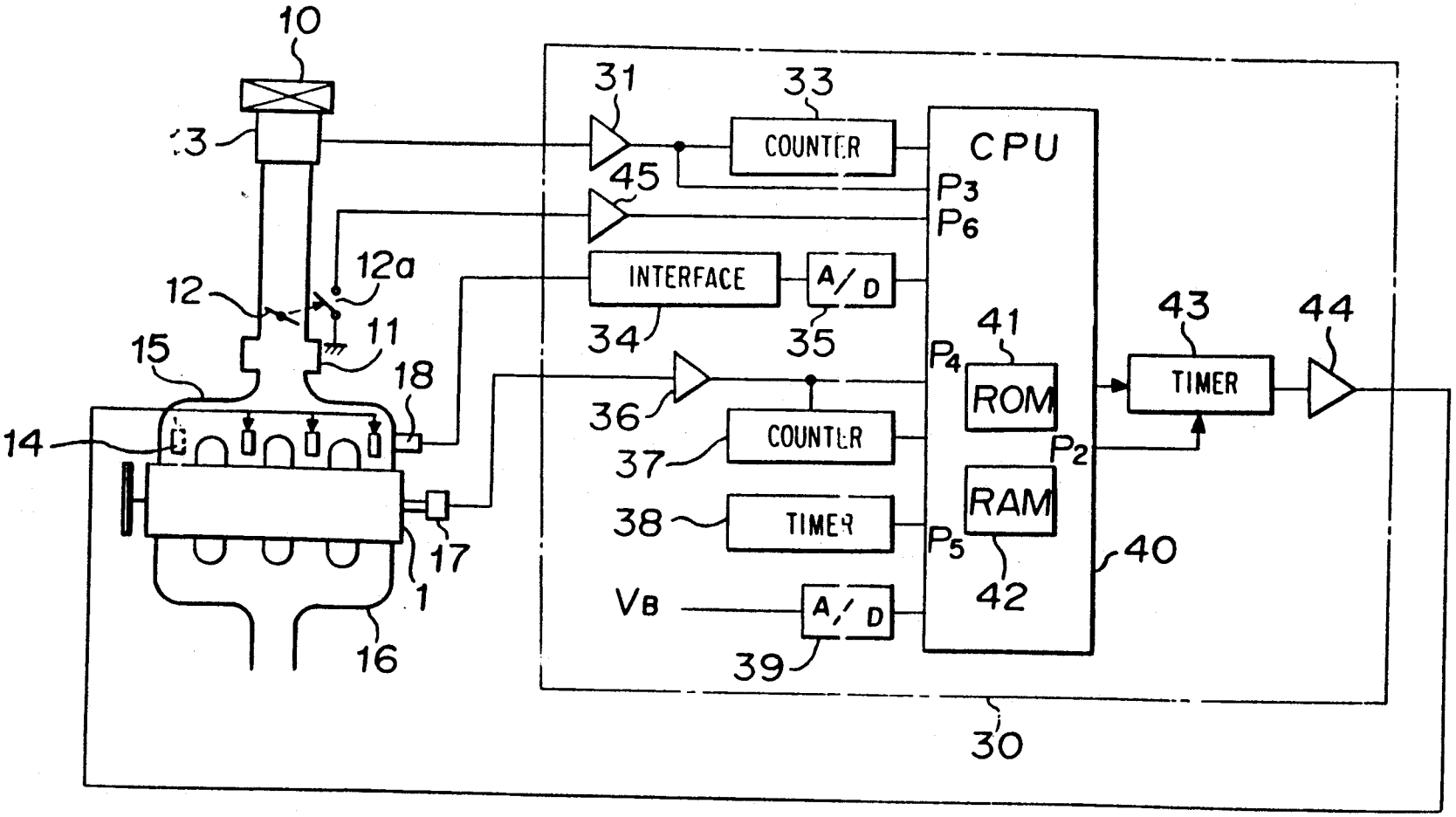
FIG. 2 is a block diagram showing in more detail the fuel control apparatus shown in FIG. 1.

FIG. 2 is a block diagram showing a detailed construction of the above-mentioned embodiment of the present invention.

In FIG. 2, a numeral 30 designates a control system which receives the output signals of the water temperature sensor 18 and the crank angle sensor 17 and controls four injectors 14 disposed at each cylinder in the internal combustion engine. The control system 30 corresponds to the AN detecting means 20 through the control means 22 as shown in FIG. 1, which is realized by a microcomputer (hereinbelow, referred to as CPU) having a ROM 41 and a RAM 42.

A numeral 31 designates a waveform shaping circuit connected to the output side of the AFS 13, which has an output terminal connected to the CPU 40 through a counter 33 and is connected directly to an input port P3 of the CPU 40.

An interface 45 is adapted to convert ON and OFF signals of the idle switch 12a into a variation of voltage, and is connected to an input port P6 of the CPU 40.

A numeral 34 designates an interface connected between the water temperature sensor 18 and an A/D converter 35 which is, in turn, connected to the CPU 40. A numeral 36 designates a waveform shaping circuit which is adapted to receive the output of the crank angle sensor 17 and supplies the output to an interruption input port P4 of the CPU 40 and a counter 37 connected to the CPU 40.

A numeral 38 designates a timer connected to an interruption input port P5; a numeral 39 designates an A/D converter which performs the A/D conversion of the voltage of a battery (not shown) and outputs the A/D converted voltage to the CPU 40, and a numeral 43 designates a timer disposed between the CPU 40 and a driver 44, the output of the driver 44 being connected to each of the injectors 14.

The operation of the fuel control apparatus of the present invention will be described. The output of the AFS 13 is subjected to waveform-shaping in the waveform shaping circuit 30 and the output wave-shaped is inputted to the counter 33. The counter 33 measures the period between trailing edges in the output of the waveform shaping circuit 31. The CPU 40 receives the signals of trailing edges of the output from the waveform the shaping circuit 31 at interruption input port P3, and at the same time, the period between the trailing edges is measured by the counter 33. The output of the water temperature sensor 18 is converted into a voltage at the interface 34. Then, the voltage signal is converted into a digital value at every predetermined time by the A/D converter 35, and the digital values are supplied to the CPU 40.

The output of the crank angle sensor 17 is inputted to the interruption input port P4 of the CPU 40 and the counter 37 through the waveform-shaping circuit 36. The CPU 40 carries out the interruption at every leading edge of the output of the crank angle sensor 17 to thereby detect the period between the leading edges of the output from the crank angle sensor 17, from the output of the counter 37. The timer 38 produces an interruption signal at every predetermined time to the interruption input port P5 of the CPU 40.

The A/D converter 39 A/D-converts the voltage of the battery (not shown), and the data of the battery voltage are taken in the CPU 40 at every predetermined time. The timer 43 is preset by the CPU 40 and is triggered at the output port P2 of the CPU 40 to thereby output pulses having a predetermined width. Thus, the output from the timer 43 drives the injectors 14 through the driver 44.

The operation of the CPU 40 will be described with reference to flow charts with reference to FIGS. 6 and 8 through 9.

Figure 6:
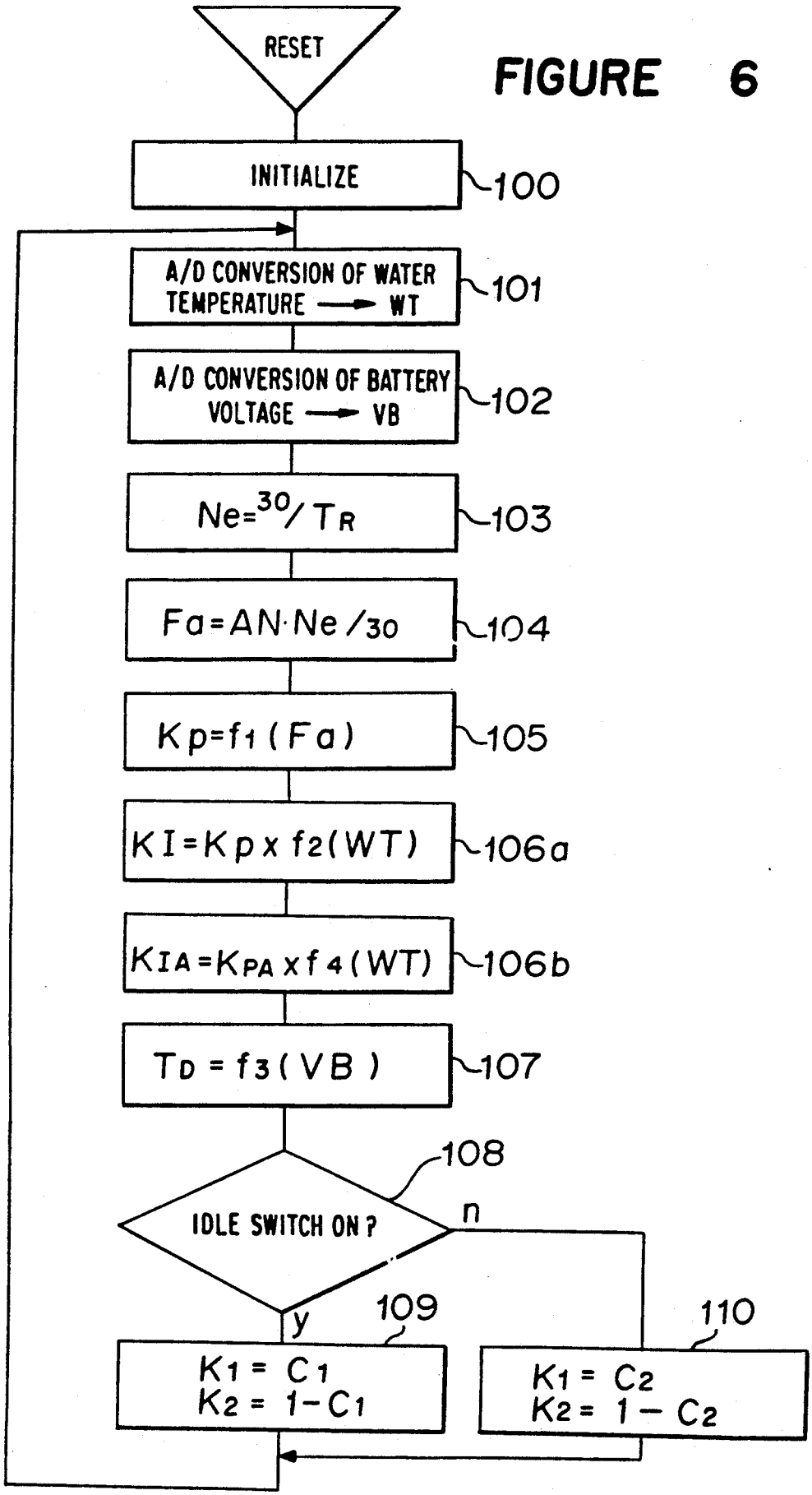

FIG. 6 shows the main program of the CPU 40. When a reset signal is inputted into the CPU 40, it initializes the RAM 42, the input and output ports and so on at Step 100. At Step 101, the output of the water temperature sensor 18 is A/D-converted, and the A/D-converted value is stored as WT in the RAM 42. At step 102, the A/D-conversion of the battery voltage is conducted and the A/D-converted battery voltage is stored as VB in the RAM 42. The calculation of $30/T_R$ is conducted from the period of the Output Of the Crank angle sensor 17 at Step 103 so that the number of revolution Ne is obtained.

At step 104, the calculation of AN·Ne/30 is carried out on the basis of the load data which will be described below and the number of revolution Ne to thereby obtain the output frequency Fa of the AFS 13. At Step 105, a basic driving time conversion coefficient Kp is calculated from a value f1 which is set with respect to the output frequency Fa as shown in FIG. 7. At Step 106*a*, the conversion coefficient Kp is corrected by the water temperature data WT to obtain the driving time conversion coefficient $K_I$ and thus obtained conversion coefficient $K_I$ is stored in the RAM 42. At Step 106 bP, the basic driving time conversion coefficient $K_{PA}$ at the time of acceleration (or increment) is corrected by the water temperature data WT to thereby obtain the driving time conversion coefficient $K_{IA}$, and thus obtained corrected conversion coefficient $K_{IA}$ is stored in the RAM. Namely, in a case that the temperature of cooling water is low, more amount of fuel adheres on the inside of the air intake pipe 15, hereby further more amount of fuel is required for the adhered fuel. On the other hand, in a case that the temperature of the cooling water is high, an amount of fuel adhering on the air intake pipe 15 is less, whereby an amount of fuel to be supplied can be small.

At Step 107, a dead time $T_D$ is obtained by mapping a data table f3 stored previously in the ROM 41 on the basis of the battery voltage data VB, and the dead time $T_D$ is stored as data in the RAM 42.

At Step 108, determination is made as to whether or not the idle switch 12*a* is in an ON state. When the determination is affirmative, the filter coefficient K1, which will be described below, is set as the coefficient C1 at Step 109, and at the same time, the filter coefficient K2 is set as (1−C1). On the other hand, when the determination is negative, K1 is set as the coefficient C2 and K2 is set as (1−C2) where C1<C2. When either Step of Steps 109 and 110 has been finished, the process of Step 101 is taken again.

FIG. 8 shows that an interruption signal is given to the interruption input port P3, namely, FIG. 8 shows an interruption treatment to the output signal of the AFS 13.

At Step 201, the output $T_F$ of the counter 33 is detected, and then, the counter 33 is cleared. The output $T_F$ of the counter 33 corresponds to the period between leading edges in the output of the AFS 13. The period $T_F$ is set as the output pulse period $T_A$ and the value is stored in the RAM 42 at Step 202. At Step 203, the residual pulse data $P_D$ is added to the integrated pulse data $P_R$ to obtain the renewed integrated pulse data $P_R$. At Step 204, a numerical value of 156 is set for the residual pulse data $P_D$. Thus, the interruption treatment is finished.

Figure 9:
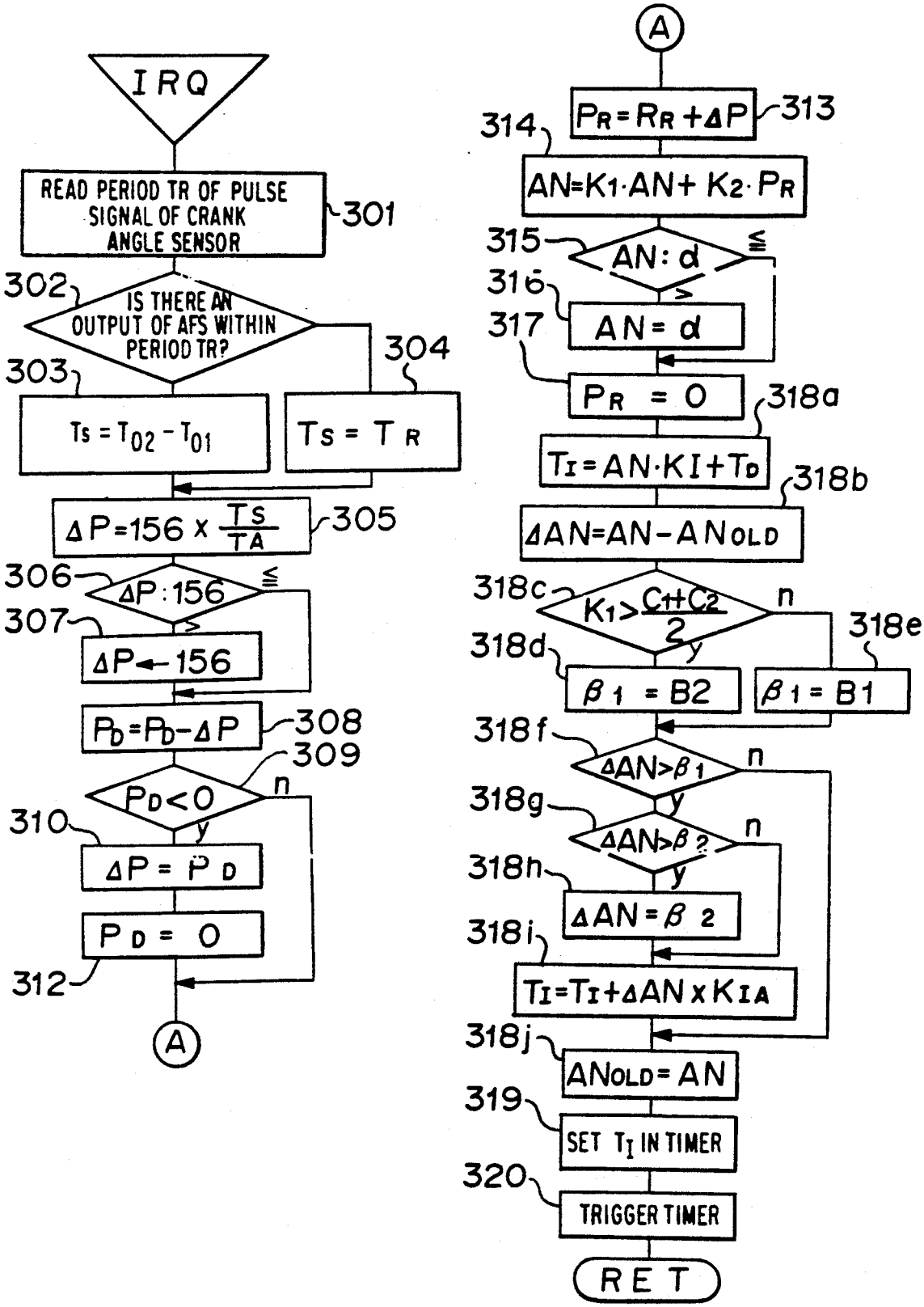

FIG. 9 shows an interruption routine in a case that an interruption signal is inputted to the interruption input port P4 of the CPU 40 in accordance with the output of the crank angle sensor 17.

At Step 301, the period between edges in the output signal of the crank angle sensor 17 is read to obtain the period $T_R$, which is stored in the RAM 42, and then, the counter 37 is cleared.

At Step 302, determination is made as to whether or not there is the output pulse of the AFS 13 within the period $T_R$. When yes, a time difference $\Delta t = t_{02} - t_{01}$ between the time $t_{01}$ of the output pulse of the AFS which has produced just before and the interruption time $t_{02}$ at the present time of the output of the crank angle sensor 17, is circulated, and the calculated value is set as the period $T_S$. On the other hand, when there is no output pulse of the AFS 13 within the period $T_R$ at Step 302, the period $T_R$ is set as the period $T_S$. At Step 305, the time difference $\Delta t$ is converted into the output pulse data $\Delta P$ of the AFS 13 by calculating the formula $156 \times T_S/T_A$. Namely, the pulse data $\Delta P$ is calculated on the assumption that the period of the output pulse of the AFS 13 at the last time is the same as the period of the output pulse thereof at the present time at Step 306. Determination is made as to whether or not the pulse data $\Delta P$ is smaller than 156. When the determination is affirmative, the sequential step goes to Step 308. Otherwise, the pulse data $\Delta P$ is cleared to be the numerical value of 156 at Step 307. At Step 308, the subtraction of the pulse data $\Delta P$ from the residual pulse data $P_D$ is carried out to obtained the renewed residual pulse data $P_D$. When the residual pulse data $P_D$ has a positive value at Step 309, the sequential step goes to Step 313. Otherwise, the pulse data $\Delta P$ is set as $P_D$ at Step 310 because the value obtained by the calculation of the pulse data $\Delta P$ is larger than the output pulse of the AFS 13. Then, the residual pulse data $P_D$ is made zero at Step 312.

At Step 313, the pulse data $\Delta P$ is added to the integrated pulse data $P_R$ to obtain the renewed integrated pulse data $P_R$. The thus obtained data $P_R$ corresponds to the number of pulses which is considered to be the output of the AFS 13 in a time between leading edges of the output at the present time of the crank angle sensor 17.

At Step 314, calculation is carried out in accordance with the formula (5). Namely, the calculation of $K1 \cdot AN + K2 \cdot P_R$ is carried out on the basis of the integrated pulse data PR and the load data AN which have been calculated until the pulse signal at the last time from the crank angle sensor 17 rises, and the thus obtained value is set as the new load data AN at the present time.

At Step 315, determination is made as to whether or not the renewed load data AN is larger than a predetermined value $\alpha$. When the load data AN is larger than the predetermined value $\alpha$, the data AN is clipped to be the value $\alpha$, whereby the load data AN is prevented from being larger than an actual value even when the internal combustion engine 1 is operated in the entirely opening condition of the throttle valve. On the other hand, when $AN \leqq \alpha$, the sequential step is jumped to Step 317. At Step 317, the integrated pulse data $P_R$ is cleared. At Step 318*a*, the calculation of the driving time data $TI = AN \cdot K1 + T_D$ is conducted on the basis of the load data AN, the driving time conversion coefficient $K_I$ and the dead time $T_D$. At Step 318*b*, the difference of $\Delta AN$ between the renewed load data AN and the load data $AN_{OLD}$ obtained at the last time is obtained. At Step 318*c*, determination is made as to whether or not the filter coefficient K1 is larger than the coefficient $(C1+C2)/2$. When the former is larger than the later, the acceleration judgement value $\beta 1$ is set as B2 at Step 318*d*. When smaller, the acceleration judgement value $\beta 1$ is set as B1 at Step 318*e*. In Steps 318*d* and 318*e*, $B1 < B2$.

At Step 318*f*, determination is made as to $\Delta AN > \beta 1$. When the $\Delta AN \leqq \beta 1$, the sequential step is jumped to Step 381*j*. On the other hand, when $\Delta AN > \beta 1$, determination is further made as to $\Delta AN > \beta 2$ at Step 318*g*. When $\Delta AN \leqq \beta 2$, the sequential step is jumped to Step 318*i*. Otherwise, $\Delta AN$ is clipped to be $\beta 2$ at Step 318*h*, and then, goes to Step 318*i*. At Step 318*i*, the driving time data $T_I$ is obtained on the basis of TI, $\Delta AN$ and $K_{IA}$. At Step 318*j*, the operation of $AN_{OLD} = AN$ is carried out and the thus obtained value is stored in the RAM 42. At Step 319, the driving time data $T_I$ is set in the timer 43, and the timer 43 is triggered at Step 320, whereby the four injectors 14 are simultaneously driven according to the driving time data $T_I$. Thus, the interruption routine is finished.

Figures 10A, 10B:
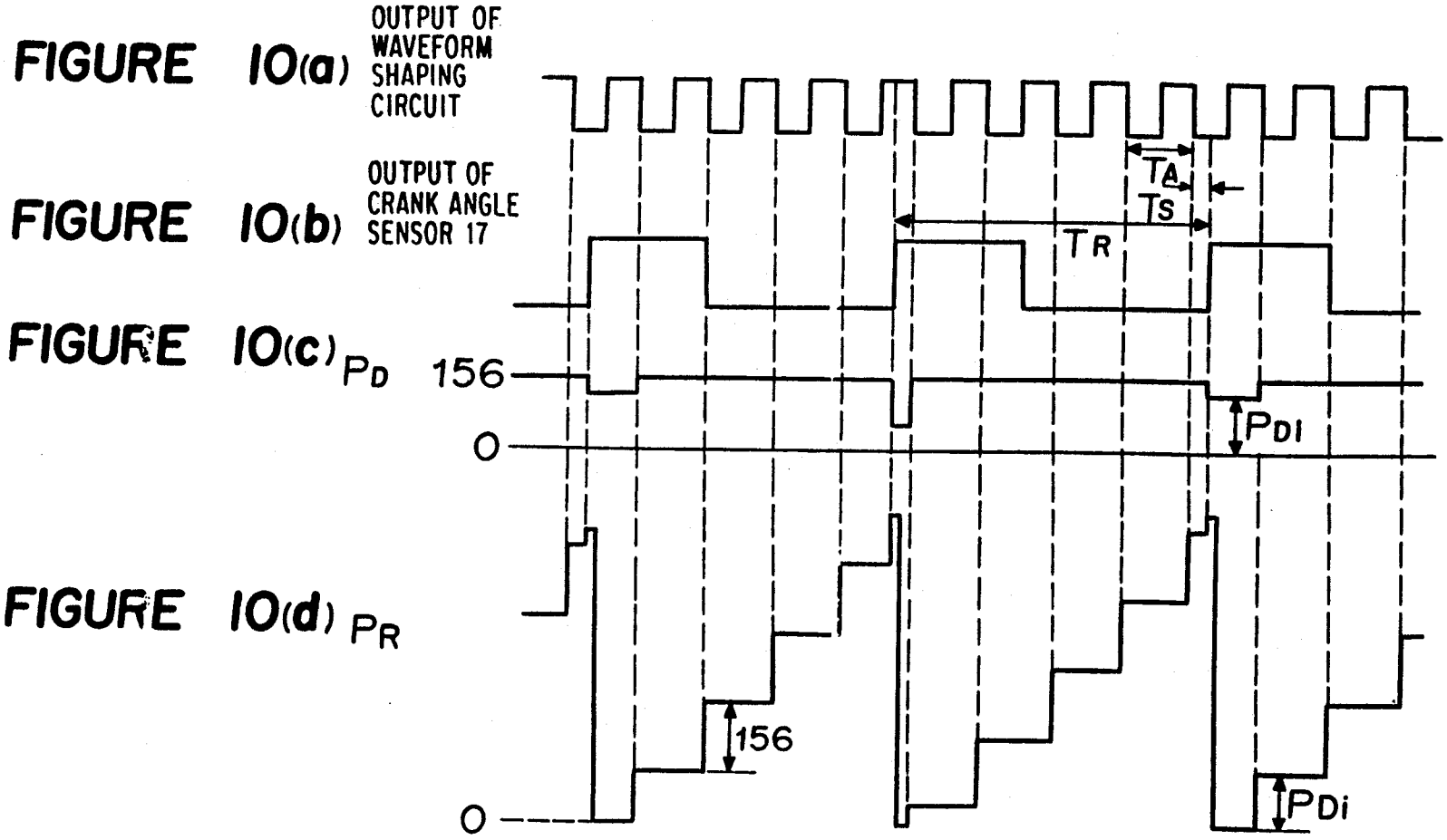
FIGS. 10(*a–d*) is a timing chart showing the timing in the flow charts in FIGS. 8 and 9.

FIGS. 10*a*–10*d* are timing charts on the treatments as in FIGS. 6 and 8–9, wherein FIG. 10*a* shows the output of the waveform shaping circuit 31, FIG. 10*b* shows the output of the crank angle sensor 17, FIG. 10*c* shows the residual pulse data $P_D$ in which the data are set to be the numerical value of 156 every trailing edge of the signal of the waveform shaping circuit 31 (the trailing edge of the output pulse of the AFS 13) and are changed in accordance with the calculation of, for instance, $P_{Di} = P_D - 156 \times T_S / T_A$ at every leading edge of the output of the crank angle sensor 17 (this corresponding to the treatments from Step 305 to Step 312), and FIG. 10*a* shows changes of the integrated pulse data $P_R$ in which the residual pulse data $P_D$ are multiplied at every time of the trailing edge of the output waveform shaping circuit 31.

In the above-mentioned embodiment, the output pulses of the AFS 13 between the leading edges of the output of the crank angle sensor 17 are counted. However, the output pulses between the trailing edges may be counted, or the output pulses of the AFS 13 during several periods of the output of the crank angle sensor 17 may be counted. Further, the number of output pulses which is multiplied by the constant which corresponds to the output frequency of the AFS 13 may be counted instead of the value obtained by counting the output pulses of the AFS 13. In addition, an ignition signal for the internal combustion engine may be used in order to detect a crank angle.

Thus, in accordance with the present invention, judgement whether correction is made in a transition time is changed depending on a change of the filter coefficient for a filter treatment. Accordingly, a correct air intake quantity for an internal combustion engine is obtainable properly, whereby an appropriate fuel control can be attained.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel control apparatus for an internal combustion engine comprising:
   - an air intake quantity detecting means to detect a parameter related to an air intake quantity for the internal combustion engine,
   - a filter means for filtering an output from the air intake quantity detecting means,
   - a switching means for changing a filter coefficient of the filter means on the basis of operational conditions of the internal combustion engine,
   - a control means to control a fuel supply quantity to the internal combustion engine on the basis of the output of the filter means, and
   - a correcting means to correct the fuel supply quantity depending on an error between an output from the filter means and another output from the same at a predetermined crank angle when the error exceeds a predetermined value, wherein the predetermined value is changed depending on the filter coefficient which is changed by the switching means.

2. The fuel control apparatus according to claim 1, wherein said switching means is an idle switch to detect the fully open position and the fully closed position of a throttle valve of the engine so that the filter coefficient is changed depending on the detected position.

* * * * *